United States Patent [19]

Kato et al.

[11] 4,375,712

[45] Mar. 8, 1983

[54] DUST COLLECTOR FOR INDUSTRIAL SEWING MACHINE

[75] Inventors: Masahisa Kato; Syouji Kasugai, both of Nagoya, Japan

[73] Assignee: Mitsubishi Denki Kabushiki Kaisha, Tokyo, Japan

[21] Appl. No.: 313,141

[22] Filed: Oct. 20, 1981

[30] Foreign Application Priority Data

Oct. 20, 1980 [JP] Japan ..... 55/146527

[51] Int. Cl.[3] ..... D05B 81/00

[52] U.S. Cl. ..... 16/282; 55/338; 55/342; 55/385 R

[58] Field of Search ..... 112/282, DIG. 1, 122, 112/129, 280; 55/385 R, 342, 338

[56] References Cited

U.S. PATENT DOCUMENTS

| | | | |
|---|---|---|---|
| 2,827,867 | 3/1958 | Happe | 112/282 X |
| 3,084,647 | 4/1963 | Matchett et al. | 112/282 X |
| 3,853,079 | 12/1974 | Dunne | 112/282 |

*Primary Examiner*—Werner H. Schroeder
*Assistant Examiner*—Andrew M. Falik
*Attorney, Agent, or Firm*—Sughrue, Mion, Zinn, Macpeak & Seas

[57] ABSTRACT

A waste collector for a sewing machine uses first and second different collection boxes, the second of which has a larger diameter suction hose than the first. The box having the larger diameter suction hose is coupled to the blower motor only through the first box via an airflow path which is more restricted than that of the larger suction hose.

6 Claims, 5 Drawing Figures

DUST COLLECTOR FOR INDUSTRIAL SEWING MACHINE

BACKGROUND OF THE INVENTION

This invention relates to dust collectors for industrial sewing machines, and more particularly to an improvement of a dust collector which can collect waste threads and rags separately.

During a sewing operation with an industrial sewing machine, especially an edge sewing machine, waste threads and cotton dust (hereinafter referred to as "waste threads") are created by the cutting of sewing threads, and pieces of small useless cloth (hereinafter referred to as "waste rags") are also created. These waste materials not only detract from the working environment but also may put the sewing machine out of order at least reduce its efficiency if they get into the sewing machine mechanism. Therefore, a dust collector has heretofore been provided for an industrial sewing machine.

In one example of a conventional dust collector for an industrial sewing machine, as shown in FIG. 1, a blower 12 is coupled to the free end of the rotor shaft of a clutch motor 10 which is the main drive source of the sewing machine, so that the blower 12 is driven by the motor rotor to apply a negative suction pressure from the blower 12 to a dust collecting box 16 through a suction hose 14. A relatively small diameter suction hose 18 and a relatively large diameter suction hose 20 are connected to the dust collecting box 16 for suction of mainly waste threads and waste rags, respectively, and the other ends of these hoses 18 and 20 are extended to waste material creating places in the sewing machine. A discharge hose 22 is connected to the discharge side of the blower 12, and its other end is open to the atmosphere.

In the conventional dust collector, as the blower 12 is rotated, the air flows in the dust collector as indicated by the arrows, as a result of which waste threads and rags are sucked into the dust collecting box 16 through respective suction hoses 18 and 20. In this operation, since the velocity of the air is decreased abruptly when it reaches the dust collecting box 16, the waste threads and rags are dropped onto the bottom of the box 16, and only the air is discharged through the blower 12.

In the conventional dust collector, the suction hoses for waste threads and rags are different in diameter and are connected to a single dust collecting box as described above. In order to suck in waste threads, the diameter of the first suction hose 18 is made small to increase its suction pressure, while the diameter of the second suction hose 20 is made large so that the suction hose 20 may not be clogged up with waste rags. However, increasing the diameter of suction hose 20 may result in a decrease in the suction pressure of suction hose 18.

Therefore, in the conventional dust collector, sometimes creating a sufficient suction negative pressure in the suction hose 18 is not compatible with preventing the suction hose 20 from being clogged up with waste rags, and in the conventional dust collector it is common for either the suction negative pressure to be insufficient or for the suction hose to be clogged up with waste materials.

SUMMARY OF THE INVENTION

In view of the foregoing, an object of the invention is to provide an improved dust collector which can positively collect waste threads and rags separately.

The foregoing object and other objects of the invention are achieved by the provision of a dust collector which, according to this invention, comprises: a blower motor disposed near a sewing machine, for collecting dust; a first dust collecting box for waste threads, which is coupled to the blower motor; a first suction hose relatively small in diameter having one end connected to the first dust collecting box and the other end set at the waste thread creating place in the sewing machine; a second dust collecting box for waste rags, which is provided separately from the first dust collecting box; a second suction hose relatively large in diameter having one end connected to the second dust collecting box and the other end set at a waste rag creating place in the sewing machine, and an air resistance adjusting hose through which the two dust collecting boxes are in communication with each other.

DETAILED DESCRIPTION OF THE INVENTION

One preferred embodiment of the invention will now be described with reference to FIG. 2.

Figure 2:
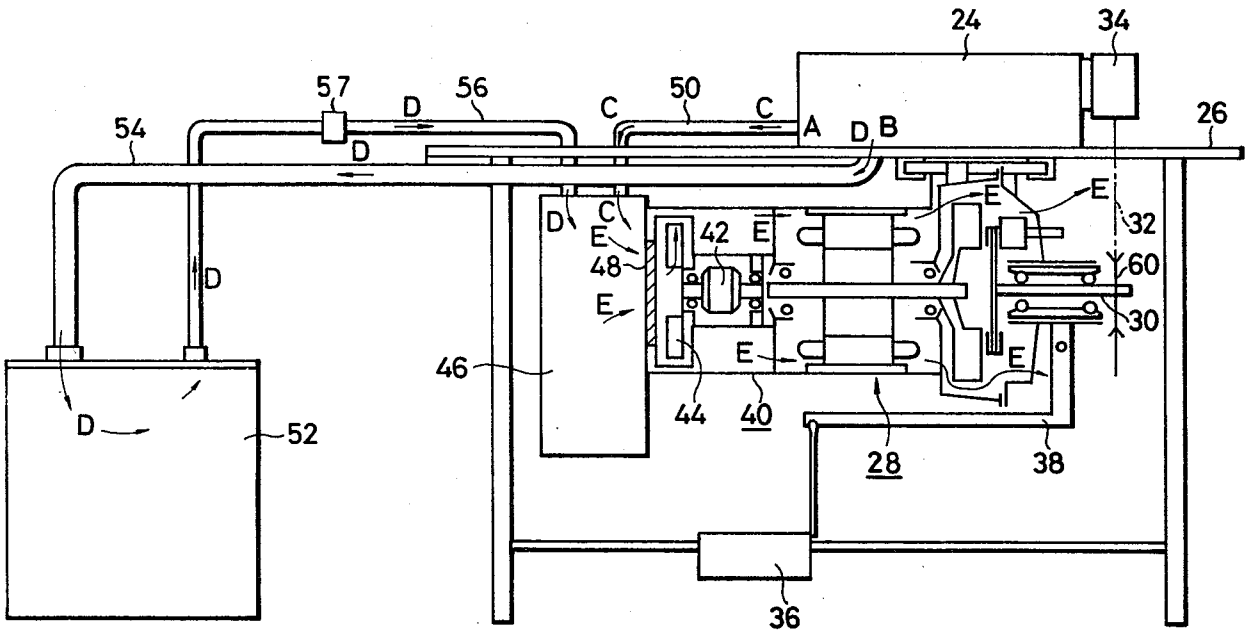
FIG. 2 is an explanatory diagram showing one preferred example of a dust collector according to this invention.

FIG. 2 is an outline of the arrangement of an overlock machine to which a dust collector according to the invention is applied. A clutch motor 28 is provided below a machine table 26 which supports an overlock machine body 24. The rotation of a clutch shaft 30, which is the output shaft of the clutch motor, is transmitted through a transmission belt 32 to a machine pulley 34. In order to control the speed of the clutch motor 28, foot pedal 35 is provided on the machine table 26. The foot pedal is connected through a clutch lever 38 to the clutch of the clutch motor, to control the engagement and disengagement of the clutch, thereby to control the speed of the machine.

In this invention, a blower motor 40 is provided adjacent to the clutch motor 28. The blower motor 40 comprises a motor 42 and an impeller 44 connected directly to the motor 42. The blower motor 40 is fixedly secured to the clutch motor 28, so that the clutch motor 28 is cooled by the air discharged by the blower motor 40.

A first dust collecting box 46 for collecting waste threads is coupled to the blower motor. A filter 48 is interposed between the dust collecting box 46 and the blower motor 40 to prevent the entrance of dust into the blower motor.

One end of a first suction hose 50 for waste threads is connected to the top of the first dust collecting box 46, and the other end is located at a waste thread creating place in the overlock machine body 24. The first suction hose 50 is relatively small in diameter to create a sufficient negative suction pressure therein, and accordingly it can positively introduce waste threads into the first dust collecting box 46.

A second dust collecting box 52 for waste rags is provided separately from the first dust collecting box 50. One end of a second suction hose 54 is connected to the top of the second dust collecting box 52, and the other end is located at a waste rag creating place in the overlock machine body 24. The second suction hose 54 is relatively large in diameter in order to suck in waste rags and to prevent the hose 54 from being clogged with waste rags.

The second dust collecting box 52 communicates through an air resistance adjusting hose 56 with the first dust collecting box 52. The adjusting hose 56 is relatively small in diameter, and distributes the negative suction pressure of the blower motor 40 to the first suction hose 50 and the second dust collecting box 52 in a predetermined ratio.

The operation of the dust collector of this invention constructed as described above will now be described.

When the power switch of the sewing machine is turned on, the clutch motor 28 starts rotation. However, in this case, the clutch is disengaged, and therefore the sewing operation of the machine is not started.

The sewing operation is started by pushing the foot pedal 36. More specifically, upon pushing of the foot pedal 36, the clutch is engaged, so that the drive power of the clutch motor 28 is transmitted to the overlock machine body 24, thus starting the sewing operation. At the same time, a switch (not shown) is turned on, so that the blower motor 40 starts the dust collecting operation. The impeller 44, being rotated by the motor 42, creates a negative suction pressure in the dust collecting path. As a result, waste threads in the waste thread creating place, or in the thread cutting mechanism, are strongly sucked in by the flow of air designated by reference characters A and C. Accordingly, a thread cutting operation can be readily achieved, and the entrance of waste threads into the sewing machine mechanism can be positively prevented. The waste threads thus sucked in are introduced into the first dust collecting box 46. Since the velocity of the air flow is abruptly decreased in the box 46, the waste threads are dropped and accumulated in the bottom of the box 46.

Similarly, waste rags at the waste rag creating place are introduced into the second dust collecting box 52 by the air flowing along the path B–D. Similarly as in the case of waste threads, the velocity of air flow is abruptly decreased in the box 52, and the waste rags are dropped and collected at the bottom of the box. Both of the air flow paths are joined into a single air flow in the dust collecting box 46, and this combined air flow runs as indicated by the arrow E. That is, after dust is removed from the air flow by the filter 48, the air flow goes through the blower motor 40 and the clutch motor 28, so as to effectively cool the motor 28.

In the above described embodiment, the first dust collecting box 46 is connected through the relatively small diameter air resistance adjusting hose 56 to the second dust collecting box 52 in order to distribute the suction negative pressure of the blower motor 40 in a predetermined ratio to the first suction hose 50 and the second dust collecting box 52; however, the pressure distribution may be further adjusted by connecting a throttle valve 57 to a part of the air resistance adjusting hose 56. In a further modification, the blower motor 40 may be connected to the first dust collecting box 46 through a communication hose rather than directly through the filter as shown in FIG. 2.

Figure 1:
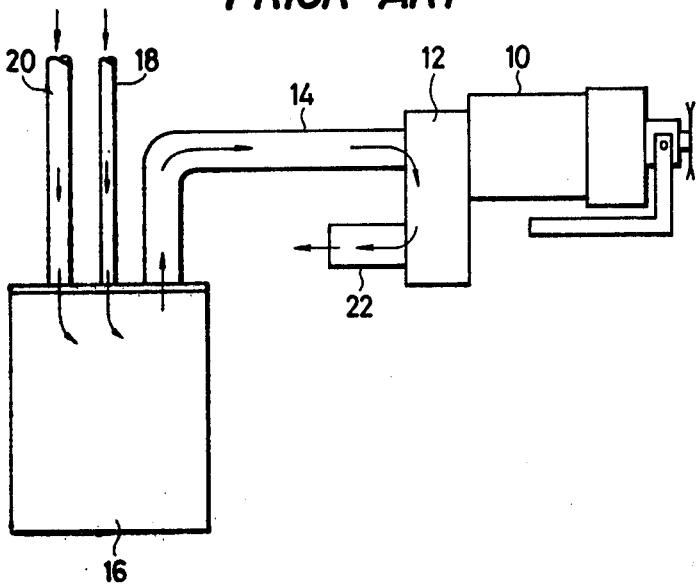
FIG. 1 PRIOR ART
FIG. 1 is an explanatory diagram showing a conventional dust collector for a sewing machine.
Figure 3:
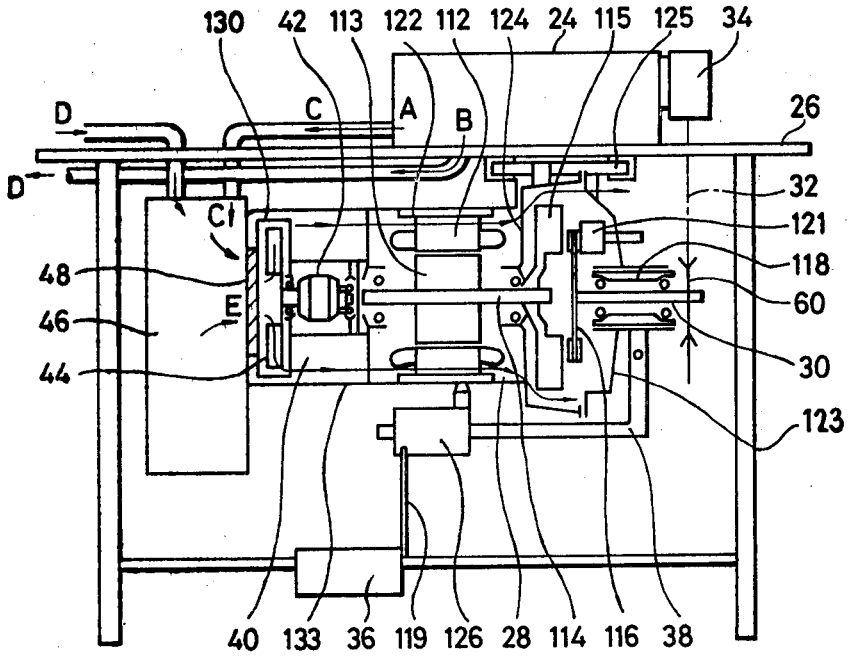
FIG. 3 is a schematic diagram showing the entire arrangement of a sewing machine with a dust collector according to this invention.
Figure 4:
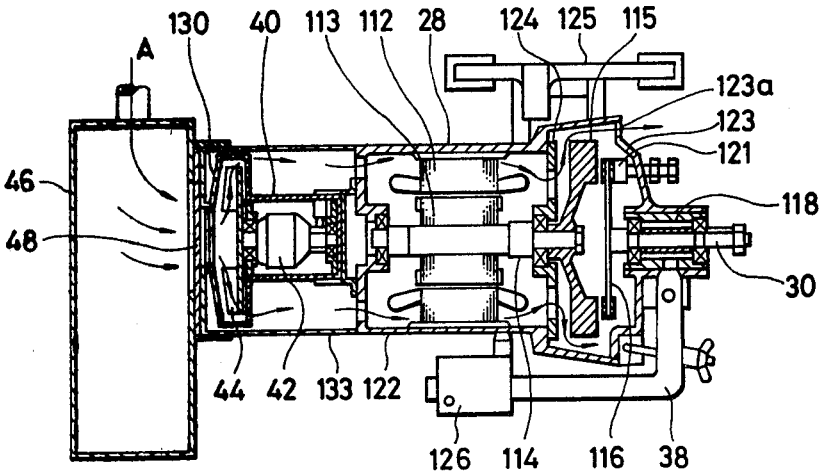
FIG. 4 is a sectional view showing the detailed construction of a clutch motor with the dust collector of FIG. 3.
Figure 5:
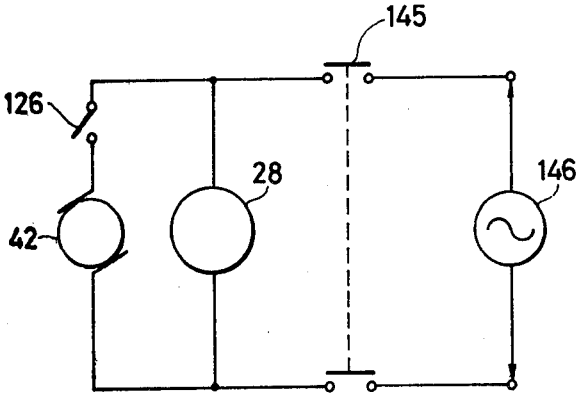
FIG. 5 is a circuit diagram showing the connection of the clutch motor and dust collector motor of FIGS. 3 and 4 to a power source.

FIG. 3 is a schematic diagram showing the entire arrangement of an overlock machine table provided with a dust collector according to an embodiment of this invention also showing a limit switch for operating the blower motor. FIG. 4 is a sectional view showing the construction of a clutch motor with the dust collecting in detail. FIG. 5 is a circuit diagram showing the connection of the clutch motor and the dust collector motor to a power source.

In these figures, reference numeral 24 designates an overlock machine body; 26, a machine table; 34, a machine pulley; 60, a motor pulley; 32, a transmission belt; and 36, a foot pedal. These components are similar to the conventional one shown in FIG. 2. Generally, a clutch motor and dust collector employed in the invention comprise a clutch motor section 28 for driving the machine, a blower motor section 40 for collecting dust, and a dust collecting box section 46. The clutch motor section 28, similar to a conventional one, comprises: a motor stator 112; a motor rotor 113; a motor shaft 114; a flywheel 115 which is secured to the motor shaft 114 so as to rotate with the latter 114; a clutch disk 116 which is engaged with the flywheel 115 when required; a clutch shaft 30 for transmitting power to the machine through the above-described pulley 50 and belt 32; a movable bearing 118 supporting the clutch shaft 30 movably in the axial direction; a clutch lever 38 which is coupled through a connecting rod 119 to the foot pedal 36 to move the clutch disk 116, clutch shaft 30 and movable bearing 118 in the axial direction, thereby to engage or disengage the clutch when required; a brake shoe 21 which, when the clutch is disengaged, is brought into frictional contact with the clutch disk 116 to quickly stop the machine; and a frame 122, a bracket 123, an intermediate bracket 124 and a base 125 incorporating and supporting the above-described various components.

A limit switch 126 is mounted on the clutch lever 38. The limit switch 126 is turned on when the foot pedal 36 is pushed to engage the clutch, i.e. when the machine is in operation, and the limit switch 126 is turned off when foot pedal is set at the neutral position to disengage the clutch, i.e. when the machine is not in operation.

The blower motor section 40 comprises; a casing 130, an impeller 44, and a blower motor 42 for rotating the impeller 44 at high speed. These components are placed in a case 133. The blower motor section 44 is secured to the side (or the left-hand side in FIG. 3) of the clutch motor section 28 which is opposite to the load side.

The power source connection is as shown in FIG. 5. More specifically, the clutch motor 28 for driving the machine and the blower motor 42 for driving the blower are connected in parallel to a power source 146 through a power switch 145.

When the power switch 145 is turned on, only the clutch motor 28 is energized; that is, only the motor rotor 113 together with the flywheel 115 is rotated under no load, and neither of the machine 24 and blower motor 42 are operated. When the operator steps on the foot pedal 36, the clutch lever 38 is turned downwardly, as a result of which the clutch disk 116 is engaged with the flywheel 115 and the machine 24 is therefore operated. At the same time, the limit switch 126 is turned on, so that blower motor 42 is energized to rotate the impeller 44 at high speed. A high wind pressure is created by the rotation of the impeller 44. The wind flows as indicated by the arrows in FIGS. 3 and 4. As a result, waste rags and threads and cotton dust creating during the operation of the sewing machine are introduced together with the wind into dust collecting boxes through dust collecting hoses. The waste materials and cotton dust, being filtered out by a dust filter 48, are collected in the dust collecting box. The wind E cleaned by the dust filter 48 passes through the blower's casing 130 and a ventilation path provided for cooling the clutch motor 28, and it is finally discharged at the side of the pulley shaft end (or the right-hand side in FIG. 3).

When, after the sewing operation has been achieved, the operator returns the foot pedal 36 to its original position, the clutch is disengaged and therefore the machine 24 is stopped. At the same time, the limit switch 126 is turned off, so that the blower motor 42 is deenergized and the blower is stopped.

This embodiment of the invention, being constructed as described above, has the following effects.

First, the blower motor section 40 and the dust collecting box section 46 are integral with the clutch motor 28, and therefore installation of the machine table set and change of the layout can be readily achieved. In this integration of the sections 40 and 46 with the clutch motor 28, the power transmission systems of the blower motor section 40 and the clutch motor section 28 are independent of each other, and therefore power transmission and connection for operating the blower by utilizing the output power of the clutch motor are unnecessary. Thus, the blower motor section and the dust collecting box section can be made integral with the clutch motor. As the blower motor section is connected directly to the dust collecting box section, no hoses or ducts for connecting the ventilation paths of the blower and the dust collecting box are required. Thus, the dust collector of the invention can be manufactured at low cost, and is high in air blowing efficiency.

Furthermore, according to this invention, the wind E created by the blower for collecting dust is used as directly a cooling wind for the clutch motor 28. Therefore, the motor can be designed at a reasonable cost.

In the case of the conventional dust collector, depending on the arrangement of the components (especially the air discharging hose or the air discharging outlet), the wind from the blower strikes the feet of the operator, which makes him feel unpleasant. On the other hand, according to this embodiment of the invention, the air from the blower is discharged through the bracket 123 and a ventilating window 123*a* of the clutch motor 28 provided at the side of the pulley shaft end where the operator will never be positioned, so that the wind from the blower may not strike the operator's feet. Thus, the drawback accompanying the conventional dust collector has been eliminated according to this invention.

Furthermore, according to this invention, the limit switch 126 is provided so that the blower motor section 40 is operated only when the machine 24 is actually operated by pushing the foot pedal, i.e. only when dust collection is required. Therefore, the dust collector of the invention can use electric power more economically than the conventional dust collector, and the period of operation of the blower which usually generates a loud noise of 80 to 100 phons can be reduced to the necessary minimum, which contributes greatly to improvement in the working environment.

In the above-described embodiment, both the dust collecting box section and the blower motor section are integral with the clutch motor; however, in order to increase the volume of the dust collecting box or the meet the dimensional limitations of the machine table, the following method may be employed, i.e., the clutch motor section may be separated from the dust collecting box or the dust collecting box may be separated from the blower motor section, and these components are connected through ventilating ducts or hoses. It can be readily understood that, in this case also, the same effects can be obtained.

As is apparent from the above description, according to this invention, two dust collecting boxes for waste threads and rags are provided separately, and the two dust collecting boxes communicate with each other through an air resistance adjusting hose which is relatively small in diameter. Therefore, although the suction hoses extended to the waste material creating places are different in diameter from each other and accordingly the negative suction pressures created therein are different, the negative suction pressure of the blower motor 40 can be effectively utilized, a small diameter high pressure airflow can be supplied to the waste thread creating place, while a large diameter low pressure air flow can be supplied to the waste rag creating place. In other words, by adjusting the pressure difference between the two suction hoses with the air resistance adjusting hose connected between the two dust collecting boxes, the dust collecting operation can be efficiently performed with only one blower motor.

As is clear from the above description, the invention has advantages that both waste threads and rags different in kind can be efficiently collected with a single blower motor, which contributes to improvement in the efficiency of a sewing operation.

What is claimed is:

1. A waste collector for an industrial sewing machine, comprising:

a blower motor having a suction inlet;

a first waste collecting box coupled to said suction inlet of said blower motor;

a first suction hose having one end connected to said first waste collecting box and the other end located at said sewing machine for collecting waste;

a second waste collecting box;

a second suction hose having one end connected to said second waste collecting box and the other end located at said sewing machine for collecting waste; and communicating means for communicating a portion of the suction pressure of said motor to said second box from said first box.

2. A waste collector as claimed in claim 1, wherein said communicating means comprises a communicating hose coupling said first and second boxes.

3. A waste collector as claimed in claim 2, wherein said communicating hose is of a diameter smaller than the diameter of said second suction hose.

4. A waste collector as claimed in claim 1 or 2 or 3, wherein said communicating means comprises an adjustable valve means disposed in an air passage between said first and second boxes.

5. A waste collector as claimed in claim 1 or 2, wherein the diameter of said first suction hose is smaller than the diameter of said second suction hose.

6. A waste collector as claimed in claim 5, wherein said other end of said first suction hose is located at a place in said sewing machine where waste threads are created, and wherein said other end of said second suction hose is located at a place in said sewing machine where waste rags are created.

* * * * *